US009643200B2

(12) United States Patent
Belanger

(10) Patent No.: US 9,643,200 B2
(45) Date of Patent: May 9, 2017

(54) SQUEEZE CONTAINER LIQUID EXTRUSION TOOL

(71) Applicant: Richard A. Belanger, Kensington, NH (US)

(72) Inventor: Richard A. Belanger, Kensington, NH (US)

( * ) Notice: Subject to any disclaimer, the term of this patent is extended or adjusted under 35 U.S.C. 154(b) by 190 days.

(21) Appl. No.: 14/577,520

(22) Filed: Dec. 19, 2014

(65) Prior Publication Data

US 2016/0175878 A1 Jun. 23, 2016

(51) Int. Cl.
*B65D 37/00* (2006.01)
*B05B 11/04* (2006.01)
*B05C 17/005* (2006.01)

(52) U.S. Cl.
CPC ..... *B05B 11/048* (2013.01); *B05C 17/00583* (2013.01)

(58) Field of Classification Search
CPC ..... B05C 17/00596; B05C 17/00583; B05C 17/0116
USPC ..... 222/210, 214, 186, 323, 325
See application file for complete search history.

(56) References Cited

U.S. PATENT DOCUMENTS 563,114 A * 6/1896 Wolff ..... F41B 9/004 222/214
605,430 A * 6/1898 Humphrey ..... F41B 9/004 222/214
617,495 A * 1/1899 Reimann ..... F41B 9/004 222/212
1,206,727 A * 11/1916 Parker ..... F41B 9/004 222/214
1,309,321 A * 7/1919 Fairweather ..... F41B 11/72 124/69
1,629,019 A * 5/1927 Cohn ..... F41B 9/004 222/214
2,629,516 A * 2/1953 Badham ..... B05B 9/0838 222/113

(Continued)

FOREIGN PATENT DOCUMENTS

BR 9101875 U 8/2013
CN 2459100 Y 11/2001

(Continued)

*Primary Examiner* — Patrick M Buechner
*Assistant Examiner* — Michael J Melaragno
(74) *Attorney, Agent, or Firm* — Ross K. Krutsinger; Mesmer & Deleault PLLC

(57) ABSTRACT

An extrusion tool includes a dispenser body having a handle portion, a container-receiving portion, and a base portion. The handle portion is connected to and extends between the container-receiving portion and the base portion. The container-receiving portion defines a forward-facing aperture and a container well extending along a container well axis, where the container well is constructed and arranged to receive and retain a squeeze container with a nozzle of the squeeze container extending through the forward-facing aperture. A trigger is operatively connected to the dispenser body and movable between a non-dispensing position and a dispensing position. The trigger has a finger portion and a contact lever portion that is oriented to move into and out of the container well when the finger portion is moved between the non-dispensing position and the dispensing position.

17 Claims, 9 Drawing Sheets

(56) References Cited

U.S. PATENT DOCUMENTS 2,802,298 A 8/1957 Larin
3,141,956 A * 7/1964 Schoenwald ..... B23K 3/0323 219/229
3,368,722 A * 2/1968 Wallace ..... B65D 35/28 222/103
3,744,921 A 7/1973 Weller et al.
3,786,683 A * 1/1974 Berman ..... B01L 3/0279 222/214
3,985,268 A 10/1976 Wood
4,324,348 A * 4/1982 Johnson ..... A47K 5/122 222/181.2
4,379,516 A * 4/1983 Barlogis ..... B05C 17/0053 222/146.5
4,523,705 A 6/1985 Belanger
4,535,916 A 8/1985 Macherle et al.
4,613,396 A * 9/1986 Scarborough ..... A47G 27/0487 118/207
4,658,991 A * 4/1987 Dziki ..... B05C 17/0053 222/146.5
D289,968 S 5/1987 Somers
4,692,587 A * 9/1987 Spirk, Jr. ..... B05C 21/00 219/242
4,771,769 A * 9/1988 Hegemann ..... A61M 11/02 128/200.22
4,776,490 A 10/1988 Wingert
4,795,064 A 1/1989 Sheu
4,815,636 A 3/1989 Stede et al.
4,826,049 A * 5/1989 Speer ..... B25H 3/006 200/51.09
4,932,565 A * 6/1990 Paradiso ..... B05C 17/00589 222/174
D313,736 S 1/1991 Boliver et al.
4,998,698 A * 3/1991 Martinson ..... B05C 17/00523 211/60.1
D316,019 S 4/1991 Belanger
D316,215 S 4/1991 Belanger
5,017,113 A * 5/1991 Heaton ..... B05C 17/00516 222/327
5,026,187 A 6/1991 Belanger et al.
5,046,877 A * 9/1991 Longo ..... B65D 35/38 222/566
5,079,013 A 1/1992 Belanger
5,195,660 A * 3/1993 Lekes ..... B65D 35/28 222/103
5,215,230 A 6/1993 Lee
D345,566 S 3/1994 Melendy et al.
5,303,853 A * 4/1994 Nye ..... B65D 83/0061 222/105
5,322,382 A * 6/1994 Hull ..... A45D 34/04 401/131
5,344,048 A * 9/1994 Bonerb ..... B65B 69/0075 222/105
5,413,258 A * 5/1995 Kartler ..... B05C 17/00516 222/575
D370,396 S 6/1996 Belanger et al.
5,553,758 A 9/1996 Melendy et al.
5,673,822 A * 10/1997 Chalmin ..... A61F 9/0008 222/183
D386,954 S 12/1997 Melendy et al.
5,881,912 A * 3/1999 Bokros ..... B05C 17/0053 219/227
5,881,924 A * 3/1999 Bokros ..... B05C 17/00526 219/227
5,890,619 A 4/1999 Belanger
5,895,159 A 4/1999 Liou
6,065,888 A 5/2000 Maayeh
6,089,412 A * 7/2000 Snell ..... B05C 17/00583 222/214
6,161,735 A * 12/2000 Uchiyama ..... B65D 83/752 222/402.13
6,241,130 B1 * 6/2001 Heiberger ..... B05C 17/0103 222/325
6,449,870 B1 * 9/2002 Perez ..... A45D 20/12 34/96
6,454,142 B1 * 9/2002 Meynet ..... B67D 1/0456 222/473
6,457,889 B1 10/2002 Lin
D469,670 S 2/2003 Belanger
6,558,059 B1 * 5/2003 Hillinger ..... B05C 17/00536 222/146.2
6,820,768 B2 11/2004 Belanger
D514,408 S 2/2006 Melendy et al.
D517,880 S 3/2006 Melendy et al.
7,140,515 B2 * 11/2006 Cardwell, III ..... F41H 9/10 222/183
7,314,328 B2 * 1/2008 Liberatore ..... B05C 17/00506 222/566
D590,674 S 4/2009 Belanger
7,520,408 B1 4/2009 Smith
7,635,070 B2 * 12/2009 Cohen ..... A61F 9/0008 222/162
7,743,948 B2 * 6/2010 Drennow ..... B67D 1/0082 222/207
2001/0030207 A1 * 10/2001 Wemyss ..... B05C 17/00516 222/567
2004/0020940 A1 * 2/2004 Whitney ..... B65D 23/003 222/92
2004/0035884 A1 2/2004 de la Guardia
2005/0082317 A1 * 4/2005 Coll ..... B05C 17/00516 222/326
2005/0109791 A1 * 5/2005 Barton, Jr. ..... B05C 17/0133 222/1
2005/0173472 A1 * 8/2005 Page ..... B05C 17/00516 222/568
2007/0045345 A1 * 3/2007 Monfeli ..... B05C 17/00526 222/173
2007/0119865 A1 * 5/2007 Belanger ..... B05C 17/00523 222/146.5
2008/0264981 A1 * 10/2008 Hjort ..... B05C 17/00516 222/533
2009/0045230 A1 * 2/2009 Liberatore ..... B05C 17/00503 222/566
2009/0152307 A1 * 6/2009 Binder ..... B65D 25/42 222/566
2010/0140293 A1 * 6/2010 Dubach ..... B05B 11/048 222/214
2010/0224651 A1 * 9/2010 Zlatic ..... A47K 5/122 222/182
2010/0237104 A1 * 9/2010 Schneider ..... B05C 17/00516 222/330
2010/0239705 A1 * 9/2010 Jorstad ..... B05C 17/00516 425/461
2010/0278958 A1 * 11/2010 Chamberlain .... B05C 17/00516 425/458
2010/0282776 A1 * 11/2010 Knopow ..... B05B 7/2443 222/145.1
2011/0089192 A1 * 4/2011 McMahon ..... B05C 17/00516 222/82
2011/0091590 A1 * 4/2011 McMahon ..... B05C 17/00503 425/87
2011/0180100 A1 * 7/2011 Hafer ..... C11D 3/30 134/6
2013/0112720 A1 * 5/2013 Cross ..... B65D 47/065 222/567
2013/0126558 A1 * 5/2013 Schneider ..... B65D 47/06 222/330
2014/0097210 A1 * 4/2014 Wright ..... B65D 47/061 222/505
2016/0175878 A1 * 6/2016 Belanger ..... B05C 17/00596 222/1

FOREIGN PATENT DOCUMENTS

CN 2669126 Y 1/2005
CN 2910372 Y 6/2006
CN 201552104 U 8/2010
CN 201889280 U 7/2011
CN 202410926 U 9/2012

(56) References Cited

FOREIGN PATENT DOCUMENTS

| | | | |
|---|---|---|---|
| CN | 202410927 | U | 9/2012 |
| CN | 203750791 | U | 8/2014 |
| DE | 7820238 | U1 | 7/1978 |
| DE | 8332750 | U1 | 3/1984 |
| DE | 10217306 | A1 | 11/2003 |
| GB | 723569 | A | 2/1955 |
| GB | 728033 | | 4/1955 |
| GB | 2263243 | A1 | 7/1993 |
| KR | 20080005312 | U | 11/2008 |
| RU | 78698 | U | 12/2008 |
| TW | 333864 | Y | 6/1998 |
| TW | 564776 | Y | 12/2003 |
| TW | 294363 | Y | 7/2006 |
| TW | 151575 | S | 2/2013 |
| TW | 449038 | Y | 3/2013 |
| WO | 20080101455 | A2 | 8/2008 |

* cited by examiner

SQUEEZE CONTAINER LIQUID EXTRUSION TOOL

BACKGROUND OF THE INVENTION

1. Field of the Invention

The present invention relates generally to applicators and extrusion devices for liquids, pastes and the like. More particularly, the present invention relates to an extrusion tool for use with adhesives and other liquids that are extruded from a squeeze container.

2. Description of the Prior Art

It has long been desirable to be able to dispense liquid products in a controlled manner, whether that product is glue, caulk, a lubricant, frosting, ketchup, paint, thixotropic resins, or any of a variety of similar liquids, gels, and flowable substances that could be extruded from a squeeze container.

One prior art applicator is a caulking gun used with tubes of construction adhesive, caulk, and grease. The caulking gun has an elongated, hollow cylindrical frame that is sized to receive tubes of caulk and the like, where the tube has an extended tip and a piston that can be advanced into and along the tube to extrude caulk through the tip of the tube. At the front end of the frame is an opening through which the tip of the caulk tube extends. At the rearward end of the frame is a handle with a squeeze trigger that operates a rod connected to a plunger. With the plunger retracted fully towards the rearward position, the user installs a tube of caulk or similar product into the frame with the tip of the tube extending through the opening at the front end of the frame. The plunger is then advanced to abut the piston of the tube, either by repeatedly squeezing the trigger or by pushing the plunger manually towards the piston. The user cuts off a part of the tip of the tube to create an opening in the tip of the tube. With the plunger abutting the piston, further advancing the plunger towards the tip of the tube drives the piston into and along the tube to force the product through the tube and out through the opening in the tip. In some embodiments, the trigger is pivotably mounted at the rearward portion of the frame adjacent the handle. The plunger rod has notches along its length, so as the user squeezes the trigger, it advances the plunger by ratcheting the rod forward. The plunger rod extends through a hole in a spring-biased metal plate. The bias on the plate maintains the hole at an angle so that the plate engages the rod, thereby preventing the plunger rod from moving in a rearward direction. The user presses the spring-biased metal plate forward to orient the hole so that the rod can freely pass through it, thereby releasing the pressure of the plunger against the tube's piston.

U.S. Pat. No. 6,820,768 (Belanger, 2004) discloses a hot melt glue gun that includes an elongate body extending along a longitudinal axis and forming an interior cavity. A heat chamber in the cavity extends generally along the axis and is configured to accept a glue stick moving into the chamber in a direction parallel to the longitudinal axis of the body. A trigger mechanism is mounted to the body and moves in a direction transverse to the longitudinal axis. The trigger mechanism is engaged by the user to move the glue into the chamber with an arm that extends from the trigger on one side of the heat chamber to an opposite side of the heat chamber to engage a gripper for advancing the glue stick. The arm includes a link that extends along the cavity, where the link is connected to the arm at one end and to the glue stick gripping mechanism at the other.

Food condiment packagers have attempted to alleviate the frustration of expelling food products such as ketchup and other condiments from squeeze bottles by manufacturing the bottle in an "upside down" orientation. As well, some of these bottles have a flexible slit and/or an elastomeric nozzle to prevent the product from freely flowing out due to gravity.

SUMMARY OF THE INVENTION

The above-described caulk guns and hot-melt glue guns of the prior art all lack the ability to be used with glue or other flowable liquids contained in a squeeze bottle. Hot met glue guns advance a stick of solid adhesive into a heated nozzle where it melts, but a hot melt glue gun could not be used with liquid adhesive or a squeeze bottle. Also, unlike caulking tubes, which dispense caulk by a plunger pushing the caulk through the tube from the rear end, products contained in squeeze bottles are dispensed by a force applied to the sidewall or body of the squeeze bottle, therefore increasing the pressure inside the squeeze bottle and causing the product to flow through the nozzle or cap.

Prior art condiment bottles made in an "upside down" configuration work sufficiently well to dispense the condiment, but only when the bottle is nearly full so that sufficient pressure can be created by squeezing the bottle to move the liquid and overcome the pressure required to open the nozzle. These condiment bottles generally offer a better overall experience than an old fashioned glass bottle, but they introduce other irritating issues to the process. This type of solution is decidedly not appropriate for adhesives of a lower viscosity and most similar liquids.

PVAc glue is commonly sold in small bottles (e.g., 4 oz) that are can be held in one's hand and that are easily squeezable by the user to dispense the product contained therein. PVAc glue and other adhesives are marketed by companies such as Borden (Elmer's brand), Duncan Enterprises (Aleene's brand), and the like. PVAc glue has viscosity from about 1,500 cps (e.g., Titebond doweling glue) to over 36,000 cps (e.g., Titebond molding and trim glue), with many varieties having a viscosity from 2000-6000 cps (e.g., titebond wood glue, yellow carpenter's glue, etc.) Of course, aliphatic resin-based adhesives (e.g., yellow carpenter's glue) and other adhesives (e.g., "Gorilla Glue") are widely known and used as well.

In addition to adhesives, icing for cake decorating, ketchup, oil and lubricants, and many other products are extruded or dispensed from a flexible plastic squeeze bottle fitted with some type of conical nozzle and cap, where the product is flowable, sometimes thixotropic, significantly more viscous than water, and intended for use at room temperature.

When a squeeze bottle of liquid is used, basic physical principles govern the function of the bottle and the liquid being dispensed. Generally, with a nearly-filled bottle fitted with a conical shaped nozzle that has an appropriately sized orifice, the bottle is stored in an upright vertical orientation with the cap or nozzle closed between uses. In this upright orientation, the liquid in the bottle flows to the bottom of the bottle due to gravity. The time needed for the liquid to level out after each use is a function of the inherent elastic property of the bottle, the viscosity of the liquid, and the ability of air evacuated during squeezing to re-enter the bottle through the nozzle. If the bottle is relatively firm, such as bottles made of HDPE, and the orifice is sufficiently large, the bottle returns to its original shape quickly and air re-enters the bottle almost instantly to expedite leveling of the liquid. On the other hand, if the bottle is made of a softer material, such as LDPE, and/or the orifice is very small (undersized), then the viscosity of the liquid causes it to remain in the bottle's orifice, therefore restricting air from re-entering the bottle and also slowing down leveling of the liquid. Similarly, a viscous liquid somewhat blocks re-entry of air into the bottle, leaving a temporary vacuum within the bottle.

In any case, when the user picks up the bottle from its upright position to apply the liquid product, the bottle must be turned to a nozzle-down orientation so that the liquid can flow to and flood the nozzle area. Flooding the nozzle is necessary to trap air in the bottle behind the liquid so its pressure can be used to push the liquid, rather than the air, through the nozzle. After the user waits for the liquid to re-flood the nozzle, the bottle is ready to dispense the product. Until then, however, the air has a flow path to exit the nozzle and the bottle therefore will only extrude air or a mixture of air and liquid.

When a volume of air is trapped behind the liquid and at equilibrium pressure with the outside air, squeezing the bottle reduces its volume, therefore increasing the pressure proportionally according to the well-known equation $P_1V_1=P_2V_2$. Of course, the pressure is highest when first squeezed and before any liquid exits the bottle. Then, as liquid exits the bottle, the volume of compressed air increases to take the place of the liquid expelled from the bottle, thus reducing pressure.

Overall, on a per squeeze basis, the user is generally content with the amount of pressure exerted by his or her fingers on the bottle, but when the pressure is exhausted, the user must let the bottle re-expand, thus "taking a breath" as air is again drawn in behind the liquid in equilibrium. In this process, often times the liquid is pulled back away from the nozzle, so restarting the extrusion of liquid is imperfect. The user then must hold the bottle in a nozzle-down orientation while sometimes resorting to jarring the bottle to get the liquid to re-flood the nozzle. For these reasons, using a conventional squeeze bottle as described can be a somewhat frustrating experience. One can imagine a fine woodworker, crafter, or child dealing with this annoying condition time after time, or holding the bottle in hand continuously to prevent it.

Further, in most squeeze bottle designs, the orifice is of a fixed diameter as determined by the manufacturer. In some cases it is a perfectly appropriate orifice size, but often it is not. Clearly, giving the user the ability to adjust the relationship between the liquid viscosity and the orifice of preference via a nozzle adjustment would improve the user's experience. While typical simple tips (known as "Yorker Tips" can be constructed with a tapered orifice area, it is up to the user to know ahead of time where along the taper to cut open the tip. Once the tip is cut "too big" there is no going back and the product will not be well controlled. Also, if the orifice is too small, the user is frustrated due to the time it takes for the bottle to take the necessary "breath" between squeezes to allow air to re-enter the bottle.

Therefore, what is needed is a squeeze bottle liquid extrusion tool that can be used with squeeze bottles containing a product to be dispensed.

An object of the present invention is to provide a tool for extruding a flowable product from a squeeze bottle.

The present invention meets this and other objects by providing an extrusion tool that receives a squeeze container and applies pressure to the squeeze container to dispense the product contained therein. In one embodiment, an extrusion tool includes a dispenser body having a handle portion, a container-receiving portion, and a base portion. The handle portion is connected to and extends between the container-receiving portion and the base portion. The container-receiving portion defines a forward-facing aperture and a container well extending along a container well axis, where the container well is constructed and arranged to receive and retain a squeeze container with a nozzle of the squeeze container extending through the forward-facing aperture. A trigger is operatively connected to the dispenser body and movable between a non-dispensing position and a dispensing position. The trigger has a finger portion and a contact lever portion that is oriented to move into and out of the container well when the finger portion is moved between the non-dispensing position and the dispensing position.

In another embodiment, the base portion has sufficient size when placed on a horizontal surface to retain the extrusion tool in an upright position with the container well positioned over the handle portion.

In another embodiment, when the extrusion tool is in the upright position, the container well axis is declined to the horizontal. In another embodiment, when the extrusion tool is at rest with a side portion facing the horizontal surface, the container well axis is declined to the horizontal. In one embodiment, the container well axis is declined from about 10 to 20 degrees with respect to the horizontal.

In another embodiment, the extrusion tool includes an adjustable stand connected to the base portion. In one embodiment, the adjustable stand is slidably received by the base portion and adjustable between a first stand position and a second stand position. In one embodiment, the adjustable stand is removable from the base portion. In another embodiment, the adjustable stand is hingedly connected to the base portion and foldable between a first stand position and a second stand position.

In another embodiment, the extrusion tool includes at least one protrusion extending transversely from the container-receiving portion, the at least one protrusion being one of a plurality of contact points when the extrusion tool is at rest with a side portion facing the horizontal surface and with the handle portion extending substantially horizontally.

In another embodiment, the extrusion tool has a trigger actuator that moves linearly with respect to the handle portion, wherein moving the trigger actuator towards the handle portion engages the finger portion to pivot the contact lever portion into the container well.

In another embodiment, the extrusion tool includes a spring connected between the trigger and the dispenser body, where the spring biases the contact lever portion to return to an at-rest position with the contact lever portion substantially retracted from the container well.

In another embodiment, the extrusion tool includes internal threads on an inside surface of the forward-facing aperture, where the internal threads are constructed to threadably engage a threaded end of the squeeze bottle. A rim coaxial with the forward-facing aperture and extends along the container well axis from the front end portion of the container-receiving portion. The rim includes external threads.

In another embodiment, the extrusion tool includes a squeeze bottle, where the squeeze bottle is sized and shaped to be retained snugly in the container well. In one embodiment, the squeeze bottle has an elastomeric body extending between a first end portion and a second end portion and a nozzle opening on the first end portion of the elastomeric body. In another embodiment, the squeeze bottle includes a threaded neck extending from the first end portion and a nozzle including the nozzle opening connected to the threaded neck portion, where the nozzle is adjustable between an open nozzle position and a closed nozzle position.

In another aspect of the invention, a method of dispensing a liquid from a squeeze bottle includes the steps of providing an extrusion tool that includes a dispenser body having a handle portion connected to and extending between a container-receiving portion and a base portion, where the container-receiving portion defines a container well with a forward aperture, the container well is constructed and arranged to receive and retain a squeeze bottle therein with a nozzle of the squeeze bottle extending through the forward aperture. The extrusion tool also has a trigger operatively connected to the dispenser body and having a finger portion and a contact lever portion, where moving the finger portion towards the handle portion moves the contact lever portion into the container well. The method also includes providing a squeeze bottle having a nozzle connected to a first end of the squeeze bottle, where the squeeze bottle contains a quantity of liquid to be dispensed; placing the squeeze bottle in the container well with the nozzle extending through the forward aperture; and squeezing the trigger, thereby causing the contact lever portion to apply pressure to the squeeze bottle to dispense some of the quantity of liquid through the nozzle.

In another embodiment, the method includes the step of selecting the extrusion tool to include a stand adjustably connected to the base portion and operable between a first stand position and a second stand position.

In another embodiment, the method includes the steps of selecting the extrusion tool to have a container well axis that is declined to the horizontal when the extrusion tool is at rest on a horizontal surface and setting the extrusion tool at rest on a substantially horizontal surface after squeezing the trigger, wherein the extrusion tool retains the nozzle in a declined orientation with the squeeze bottle extending along the container well axis.

In another embodiment of the method, the step of setting the extrusion tool at rest includes setting the extrusion tool substantially on a side portion with the handle portion extending substantially horizontally.

DETAILED DESCRIPTION OF THE PREFERRED EMBODIMENT

Figure 1:
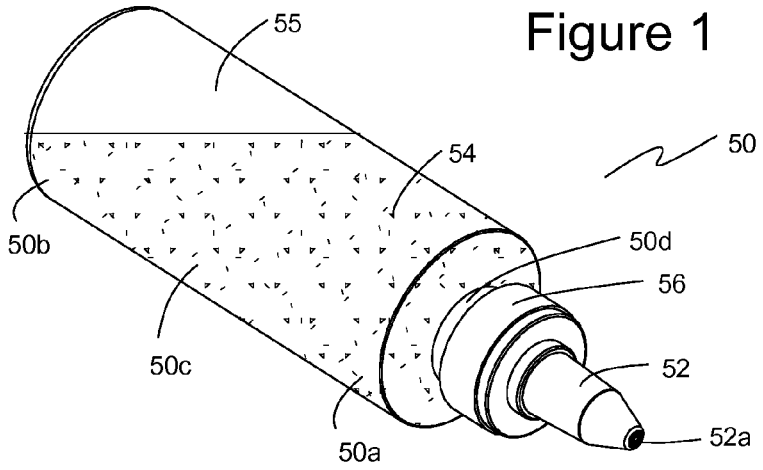
FIG. 1 is a front perspective view of one embodiment of the present invention showing an extrusion tool and a squeeze bottle sized to be received in the container well of the extrusion tool.
Figure 1:
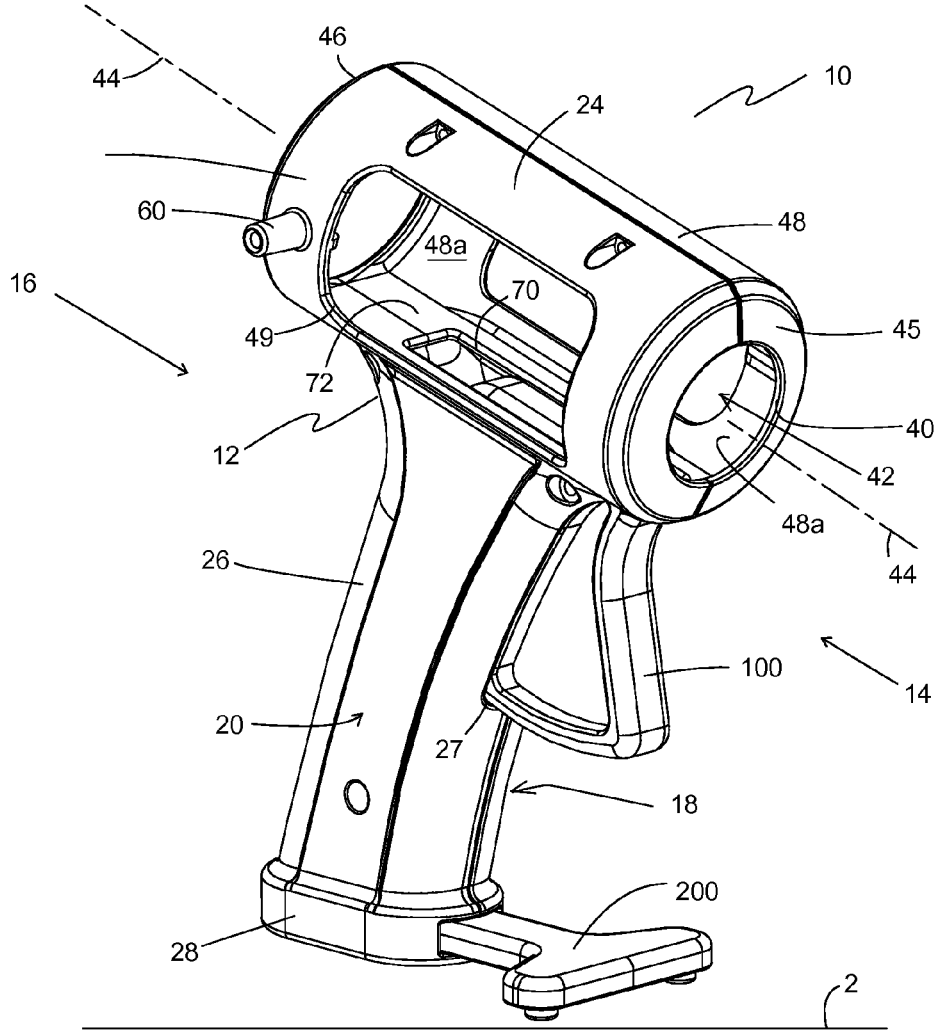

The preferred embodiments of the present invention are illustrated in FIGS. 1-11. FIG. 1 illustrates a front, top, and side perspective view of one embodiment of an extrusion tool 10 usable with a liquid or other flowable product 54 contained in a squeeze container 50. Squeeze container 50 may be, for example, a bottle, a tube, or other type of container. Extrusion tool 10 has a dispenser body 12 with a front portion 14, a rear portion 16, a first side portion 18, and a second side portion 20. Dispenser body 12 includes a container-receiving portion 24, a handle portion 26, and a base portion 28, where the handle portion 26 is connected to and extends between container-receiving portion 24 and base portion 28. A trigger 100 is operatively connected to dispenser body 12.

Container-receiving portion 24 has a front end 45 that defines a forward-facing aperture 40. Container-receiving portion 24 has a peripheral sidewall 48 that defines container well 42 extending longitudinally along a central container well axis 44 between front end 45 and a rear end 46. Container-receiving portion 24 is constructed and sized to receive and retain a squeeze container 50 in container well 42 with a dispensing nozzle 52 extending through forward-facing aperture 40.

In some embodiments, container well 42 provides a snug fit to squeeze container 50. In one embodiment container well 42 provides a snug fit along first end portion 50*a* (e.g., cap-end portion) and/or second end portion 50*b* (e.g., base portion) of squeeze container 50. For example, first and second end portions 50*a*, 50*b* are retained snugly by container-receiving portion 24, while a middle portion 50*c* of squeeze container 50 has ample space to distort when it is "squeezed" by trigger 100. In one embodiment, container well 42 achieves this snug fit in particular areas of squeeze container 50 by having a reduced diameter at the corresponding location.

In one embodiment, the size and shape of container well 42 allows for expansion through one or more opening 49 defined in peripheral sidewall to an unlimited degree while holding first end portion 50*a* and second end portion 50*b* firmly against an inside surface 48*a* of peripheral sidewall 48. Accordingly, actuation of trigger 100, explained below, allows squeeze container 50 to be compressed and deform as if held and squeezed in one's hand. Opening(s) 49 also allow the user can see and/or adjust the position of squeeze container 50 retained in container well 42 as may be desirable, for example, to visually identify the product 54 contained within squeeze container 50.

In some embodiments, container well 42 has an oval or other cross-sectional shape consistent with and suitable for holding and retaining squeeze container 50 having that shape. For example, some squeeze containers 50 for glue have an ovoid cross-sectional shape. This ovoid cross-sectional shape of container well 42 may be oriented with a major axis extending vertically, horizontally, or somewhere in between. Some squeeze containers 50 having a cross-sectional shape different from that of container well 42 may still sufficiently fill container well 42 so that trigger 100 compresses squeeze container 50 to dispense product 54.

In one embodiment, rear end 46 of container-receiving portion 24 is open so that squeeze container 50 may be inserted into container well 42 through rear end 46. In other embodiments, peripheral sidewall 48 has one or more opening 49 sized to permit squeeze container 50 to be inserted into container well 42. For example, peripheral sidewall 48 substantially has a C shape with opening 49 being a slot extending between rear end 46 to front end 45 with a size sufficient to allow squeeze container 50 to be placed into container well while also retaining squeeze container 50 when the user actuates trigger 100, which is discussed below. In yet other embodiments, container-receiving portion 24 opens, such as with a clamshell design, to allow squeeze container 50 to be placed in container well 42. For example, a first container-receiving portion (e.g., a top half) is hingedly connected to a second container-receiving portion (e.g., bottom half). The first container-receiving portion can be closed securely to retain squeeze container 50 in container well 42.

In some embodiments, container well 42 is inclined/declined with respect to a horizontal surface 2 (e.g., a table or work surface) when extrusion tool 10 is standing at rest with base portion 28 on horizontal surface 2. In these embodiments, the inclination from front to back is in the range of about 10-20°. In one embodiment, container well 42 is inclined to horizontal surface 2 whether extrusion tool 10 is standing on base portion 28 in an upright position with container-receiving portion 24 over handle portion 26, or whether extrusion tool 10 is on its side with first side portion 18 or second side portion 20 facing horizontal surface 2 and handle portion 26 extending approximately horizontally.

Optionally, container-receiving portion 24 includes one or more bosses or side support protrusions 60 that extend transversely from dispenser body 12. In one embodiment, protrusion(s) 60 extend from container well sidewall 48 adjacent rear end 46 and/or from handle portion 26 adjacent base portion 28. Side support protrusion(s) 60 allow extrusion tool 10 to be set on its side while still providing a 10-20° downward orientation of the squeeze container 50 toward nozzle 52. The user may choose to remove stand 200 at his/her discretion. Side support protrusion(s) 60 is (are) useful as one of several contact points when extrusion tool 10 is on its side, where extrusion tool 10 contacts horizontal surface 2 with protrusion 60, base portion 28, and front portion 14 of container-receiving portion 24. Side support protrusion 60 extends a sufficient length to cause container well 42 to be declined (or inclined, depending on one's perspective) with respect to horizontal surface 2 when extrusion tool 10 is on its side, where rear end 46 is positioned vertically higher than front end 45. As such, nozzle 52 of squeeze container 50 is downwardly tilted. A benefit of container well 42 being declined is that product 54 tends to flow towards (i.e., "flood") nozzle 52 when extrusion tool 10 is at rest so that product 54, rather than air, is located at a nozzle opening 52*a* and ready to be dispensed without delay.

Handle portion 26 connects to and extends from container-receiving portion 24 to base portion 28. Handle portion 26 is sized to be gripped in the hand of a user. In one embodiment, handle portion 26 connects to bottom sidewall portion 72 of container well sidewall 48 and extends transversely (e.g., approximately perpendicularly) from container-receiving portion 24. Handle portion 26 may be connected to container-receiving portion 24 at other locations so long as handle portion 26 enables operation of trigger 100 to dispense product 54. In one embodiment, container-receiving portion 24 defines a contact lever opening 70 through a bottom sidewall portion 72 of container well sidewall 48. In one embodiment, handle portion 26 also defines a trigger opening 27 along front portion 14 to allow trigger 100 to pivot or slide into handle portion 26.

Figure 2:
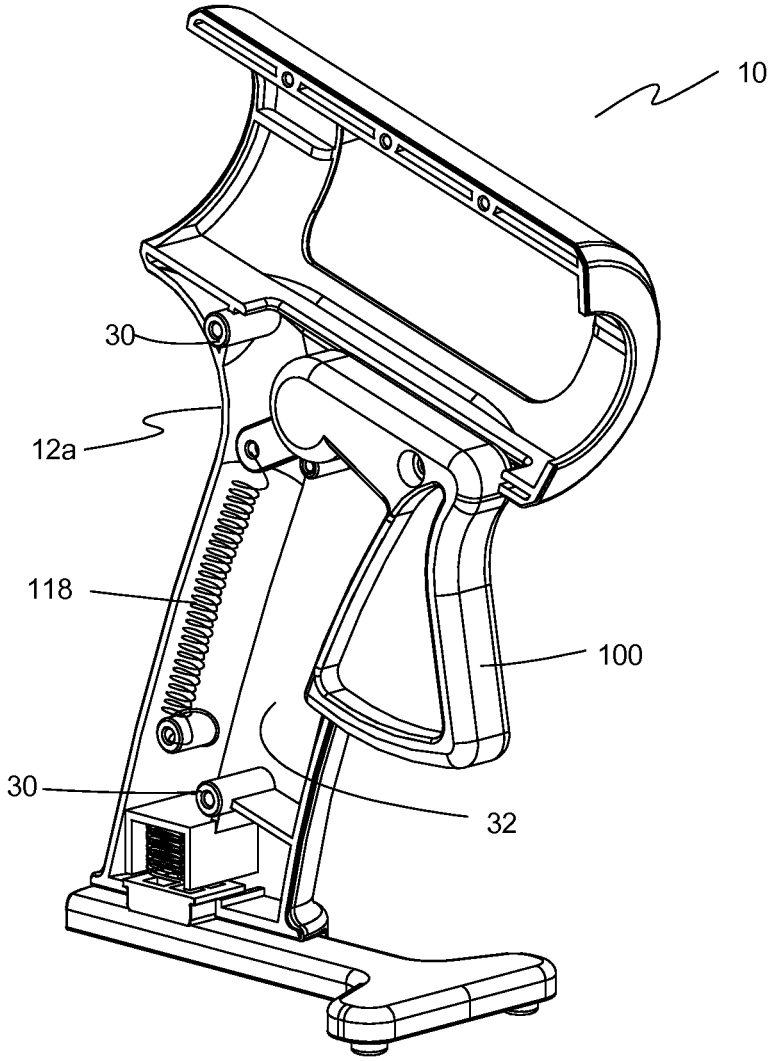
FIG. 2 is a sectional view of a portion of the extrusion tool of FIG. 1 showing details of a trigger and a stand.

Referring now to FIG. 2, a perspective cutaway view shows a first body portion 12*a* of extrusion tool 10 with trigger 100 and trigger return spring 118. In one embodiment as shown in FIG. 2, dispenser body 12 comprises a first body portion 12*a* and a second body portion 12*b* (not shown) that assemble together. In one embodiment, second body portion 12*b* is substantially symmetrical to first body portion 12*a* along a longitudinal plane of extrusion tool 10. Screws or other connectors (not shown) extend between first and second body portions 12*a*, 12*b* to hold body portions 12*a*, 12*b* together. For example, body portions 12*a*, 12*b* are substantially hollow and include one or more fastener posts 30 as are known in the art of plastics manufacturing. Trigger 100 is partially received in and moves within a cavity 32 defined between body portions 12*a*, 12*b*.

Figure 3:
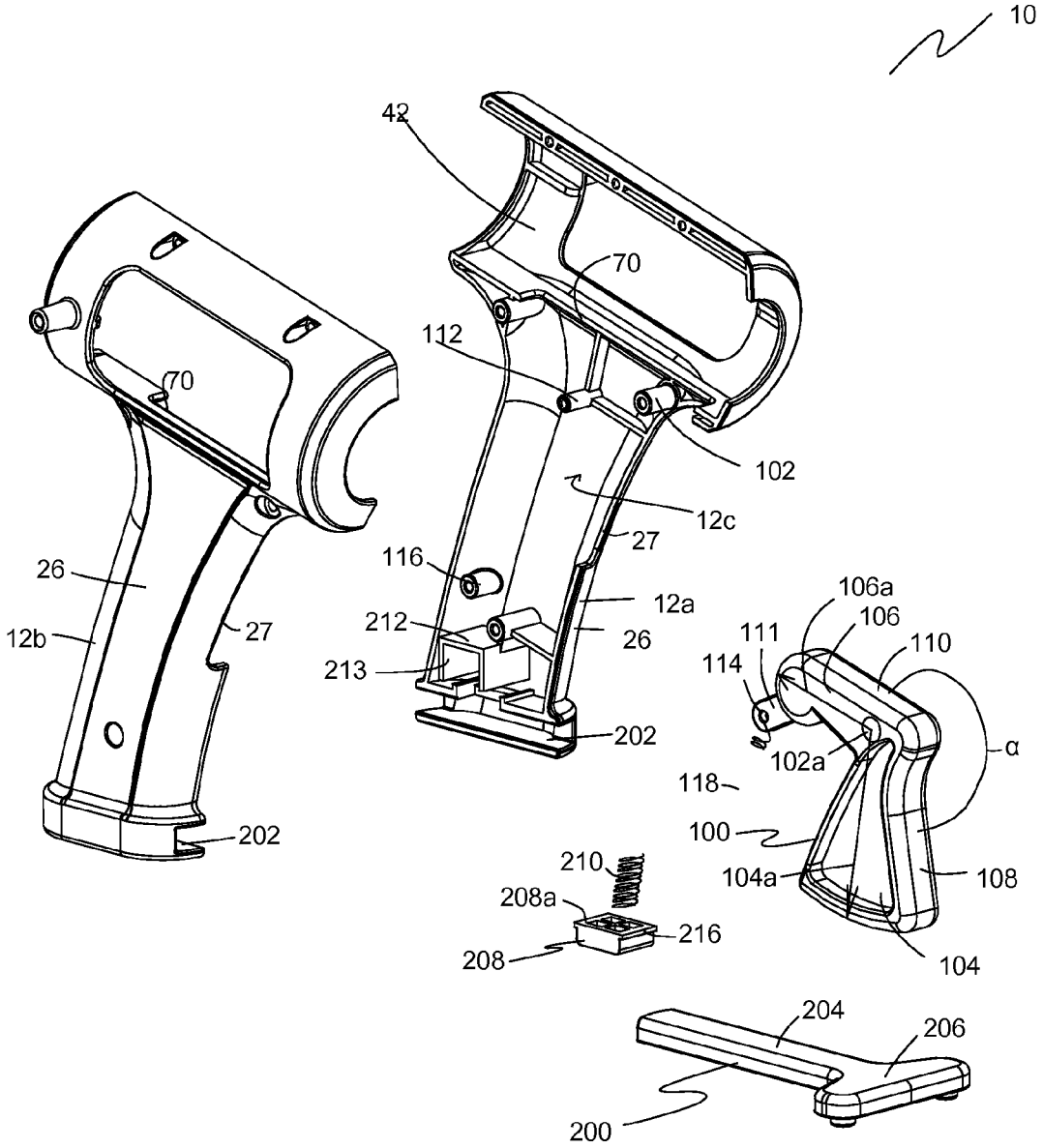
FIG. 3 is an exploded view of the extrusion tool of FIG. 1 showing a dispenser body, a trigger and a stand.

Referring now to FIG. 3, an exploded, perspective view shows components of one embodiment of extrusion tool 10, including dispenser body 12 with first body portion 12*a* and second body portion 12*b*, trigger 100, and stand 200. As illustrated, handle portions 26 of body portions 12*a*, 12*b* define trigger opening 27 and contact lever opening 70.

A trigger is operatively connected to the dispenser body and movable between a non-dispensing position and a dispensing position. In one embodiment, trigger 100 is pivotably mounted to a trigger pin 102 on dispenser body 12. For example, trigger pin 102 is a steel pin fitted to or plastic pin molded into dispenser body 12 and that extends to engage trigger 100. Trigger 100 includes finger portion 104 and contact lever portion 106. Contact lever portion 106 is oriented to move into and out of the container well 42 when finger portion 104 is moved between the non-dispensing position and the dispensing position. Finger portion 104 includes finger contact surface 108, such as a forward-facing surface that the user's fingers contact during use of extrusion tool 10. Similarly, contact lever portion 106 includes container contact surface 110, such as a surface facing container well 42. Finger contact surface 108 extends transversely from container contact surface 110 to define an outside angle $\alpha$ from about 240° to about 270° (i.e., an inside angle from about 90° to about 120°). Thus, in its upright position where when finger contact surface 108 is approximately vertical, container contact surface 110 is substantially parallel to container well 42. Other values of angle $\alpha$ are acceptable and are a function of the desired degree of decline for container well 42, the position of trigger 100, the position of handle portion 26, and various ergonomic considerations.

When a user squeezes finger portion 104 towards handle portion 26, trigger 100 pivots about trigger pin 102 to cause contact lever potion 106 to move into container well 42. In one embodiment, a length 106*a* of contact lever portion is about equal to a length 104*a* of finger portion 104 as measured from pivot point 102*a* for trigger pin 102. Accordingly, the force exerted on finger portion 104 results in corresponding force by contact lever portion 106 as it acts on squeeze container 50 retained in container well 42.

In another embodiment, trigger 100 is shaped to provide a mechanical advantage to the user, that is, to provide a smaller squeeze force by the user to achieve a greater force on squeeze container 50. To achieve this result, length 106*a* of contact lever portion 106 is reduced relative to length 104*a* of finger portion 104. Compared to a ratio of lengths 104*a*:106*a* of about 1:1 (no mechanical advantage) a ratio of lengths 104*a*:106*a* about 1.6:1 results in a force on trigger 100 that feels easier as compared to triggers with a 1:1 length ratio. More importantly, a ratio of lengths 104*a*:106*a* about equal to 1.6:1 makes squeezing trigger 100 easier than squeezing squeeze container 50 in one's hand without the use of extrusion tool 10.

In one embodiment, trigger 100 is sized and shaped to provide a predefined amount of purposeful interference with squeeze container 50 retained in container well 42. In its resting state, instead of having container contact surface 110 flush with or recessed from contact lever opening 70, contact lever portion 106 extends into container well 42 to engage and slightly compress squeeze container 50. In one embodiment, purposeful interference occurs with contact lever portion 106 tangentially contacting the outside surface of squeeze container 50. This purposeful interference provides sufficient frictional engagement and/or deformation of squeeze container 50 to prevent squeeze container 50 from falling out of container well 42 due to gravity when extrusion tool 10 is inverted. In one embodiment where squeeze container substantially occupies the full volume of container well 42, contact lever portion 106 interferes with squeeze container by about 0.020 to about 0.030 inch. Stated differently, contact lever portion 106 deforms squeeze container sidewall by about 0.020 to about 0.030 inch. This purposeful interference effectively grips squeeze container 50 so that it is held snugly in container well 42, does not move within container well 42 when being squeezed, or fall out when extrusion tool 10 is inverted.

To facilitate purposeful interference, trigger 100 optionally includes a trigger stop 111 extending from contact lever portion 106 and positioned to engage a trigger stop protrusion 112 in cavity 32 of body portion 12. For example, trigger stop protrusion 112 extends from an inside surface 12*c* of body portion 12 into the path of travel of trigger 100. Trigger stop protrusion 112 is positioned to make contact with trigger stop 111 (or contact lever portion 106 or other portion of trigger 100) as contact lever portion 106 pivots away from container well 42 to the at-rest or resting position as shown, for example, in FIG. 2. Thus, trigger stop protrusion 112 prevents contact lever portion 106 from moving beyond a predefined location in the direction away from container well 42 and fixes the position of contact lever portion 106 when it is in the resting position with squeeze container 50 disposed in container well 42. Squeeze container 50 being slightly compressed applies pressure to contact lever portion 106 to maintain trigger 100 engaged with trigger stop protrusion 112. Trigger stop protrusion 112 may be positioned to contact other portions of trigger 100 along contact lever portion 106 or finger portion 104.

Trigger 100 optionally defines a catch or spring opening 114 as an attachment point for one end of a trigger return spring 118 that extends between contact lever portion 106 (e.g., trigger stop 111) and a spring post 116 or other connection point in body 12. Trigger return spring 118 biases trigger 100 towards the resting position with contact lever portion 106 positioned outside of container well 42 to the extent permitted by trigger stop protrusion 112.

In one embodiment, trigger return spring 118 has a spring force sufficient to quickly retract trigger 100 to the resting position upon release of trigger 100 by the user, thereby allowing squeeze container 50 to return to its normal shape to the extent permitted by the purposeful interference with trigger 100. When trigger 100 retracts to the resting position, the increase in volume of squeeze container 50 creates a vacuum that draws air and stray product 54 into nozzle 52 through nozzle opening 52*a* as squeeze container 50 resumes equilibrium pressure. The user will witness the would-be drool or drip of liquid product 54 sucked back into nozzle 52 since the relationship of the viscosity of product 54 to the size of nozzle opening 52*a* is such that the small volume of product 54 within nozzle 52 does not drool or drip when nozzle 52 of squeeze container 50 is declined.

Desirable to the function of some embodiments of extrusion tool is that squeeze container 50 is maintained in a declined orientation and air is drawn through nozzle opening 52*a* while product 52 floods nozzle 52 and the area around nozzle 52. As air fills a void 55 (shown in FIG. 1) in squeeze container 50 behind product 54 at a rate determined by the resiliency of squeeze container 50, product 54 is consistently and continually ready at nozzle opening 52*a* to be dispensed with no time delay and no spitting. Similar squeeze containers 50 used without extrusion tool 10 will dispense product 54, but the user will experience delays for the time it takes for air to re-enter the container and the time for product 54 to re-flood nozzle 52 where it is ready to be extruded or dispensed. In short, the user of squeeze containers 50 used without the aid of extrusion tool 10 will experience delays and erratic product 54 delivery.

In one embodiment, base portion 28 includes a stand 200 that slides out of a stand opening or slot 202 in base portion 28 for more stably supporting extrusion tool 10 in the upright position. When not needed, or for more compact stowage, stand 200 slides into base portion 28 or may be removed completely. In one embodiment, stand 200 includes a neck portion 204 and a foot portion 206 that are connected in a T shape, where neck portion 204 is slidably received in stand opening or slot 202 of base portion 28.

In one embodiment, body 12 includes a friction foot 208 that exerts a holding force on neck portion 204 of stand 200. The holding force is provided by a compression spring 210 disposed between a spring plate 212 in body 12 and friction foot 208. Spring plate 212 in one embodiment is part of an enclosure or spring housing 213 having an open bottom for compression spring 210. Friction foot 208 is disposed in a foot opening 214 and capable of extending through foot opening 214 to frictionally engage stand 200. Compression spring 210 biases friction foot 208 against stand 200 to maintain stand 200 in the preferred, adjusted position chosen by the user. Stand 200 is easily adjusted or completely removed from base portion 28 by the user if desired, such as when the user finds that stand 200 interferes with positioning nozzle 52 in a tight inside corner of a box.

In one embodiment, friction foot 208 includes a flange 216 that acts as a stop to prevent friction foot 208 from passing freely through foot opening 214. In one embodiment, friction foot 200 has a rectangular cross-sectional shape where flange 216 extends partially or completely around the perimeter edge adjacent a top foot surface 208*a*. Flange abuts the rim of foot opening 214.

Figure 4:
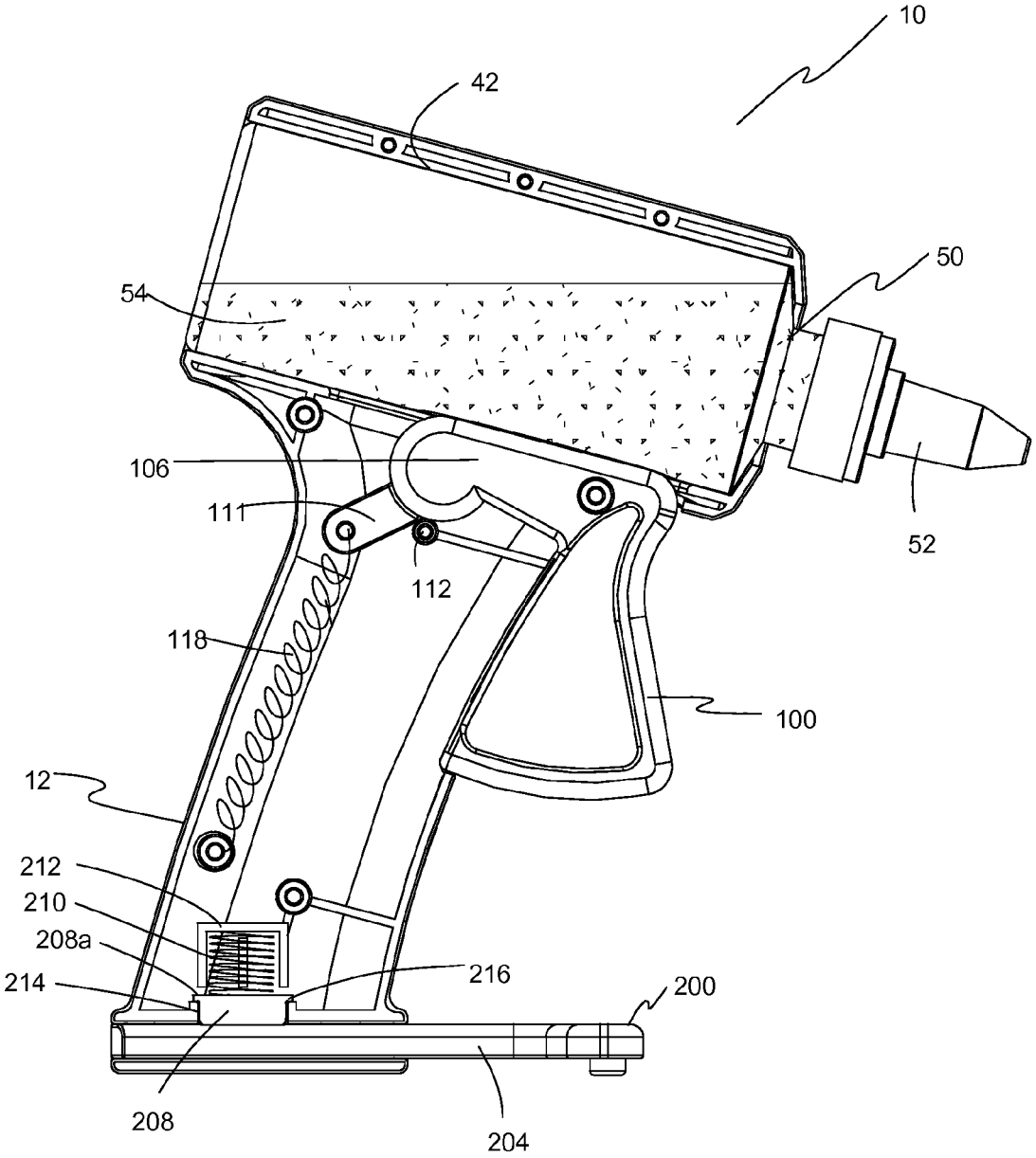
FIG. 4 is a side elevational view of the extrusion tool of FIG. 2 showing the bottle disposed in the container well and the trigger in the at-rest position.

Referring now to FIG. 4, a side elevational view shows one embodiment of extrusion tool 10 in an upright position with squeeze container 50 retained in container well 42.

Product 54 floods nozzle 52 due to the decline of squeeze container 50 to the horizontal. Trigger 100 is in a first or resting position with contact lever portion 106 abutting and slightly pressing into squeeze container 50. Trigger return spring 118 biases contact lever portion 106 to pivot and come to rest against trigger stop protrusion 112. Stand 200 extends from base portion 28 with friction foot 208 biased by compression spring 210 to frictionally engage neck portion 204 to maintain its position. In the event that stand 200 is removed from base portion 28, flange 216 prevents friction foot 208 from passing through foot opening 214 and becoming lost.

Figure 5:
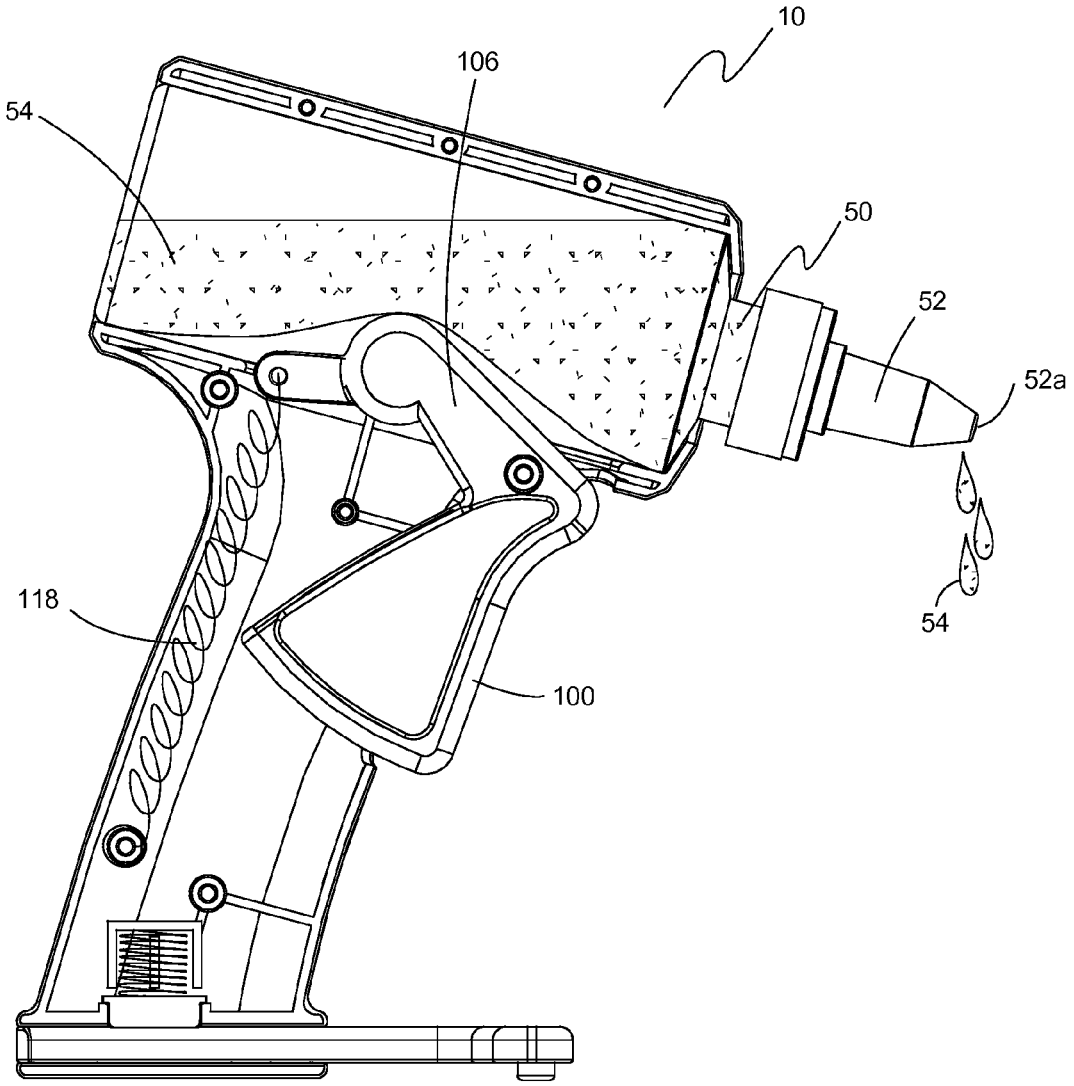
FIG. 5 is a side elevational view of the extrusion tool of FIG. 2 showing the trigger in an actuated position.

Referring now to FIG. 5, a side elevational view shows extrusion tool 10 of FIG. 4 in an upright position with squeeze container 50 retained in container well 42. Trigger 100 is actuated in the second or dispensing position with contact lever portion 106 deforming squeeze container 50. As squeeze container 50 is deformed by contact lever portion 106, the reduced volume and increased pressure in squeeze container 50 causes product 54 to be dispensed through nozzle opening 52*a*. Trigger 100 remains biased by trigger return spring 118, which is now extended, to return to the resting position when the user releases it.

Figure 6A:
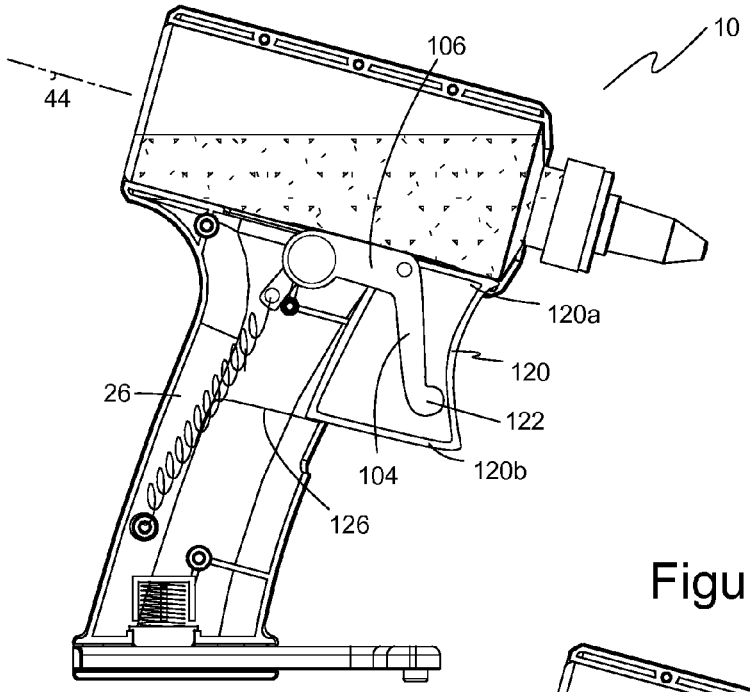
FIG. 6A is a side elevational view of a section of another embodiment of an extrusion tool showing a trigger actuator with linear movement in the at-rest position.
Figure 6B:
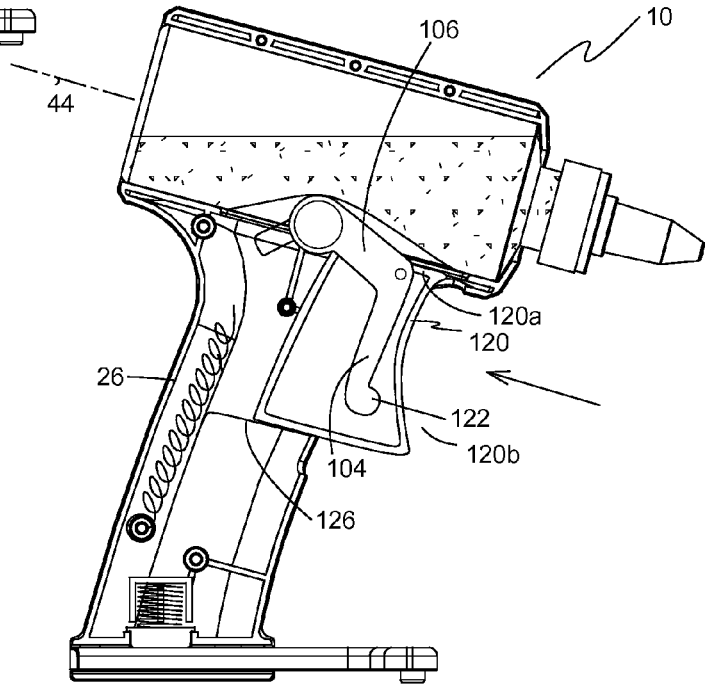
FIG. 6B is a side elevational view of the section of FIG. 6A showing the trigger actuator with linear movement in an actuated position.

Referring now to FIGS. 6A and 6B, side sectional views are shown of another embodiment of extrusion tool 10. In this embodiment, extrusion tool 10 includes a trigger actuator 120 that moves linearly to pivot contact lever portion 10 about trigger pin 102. In one embodiment, trigger actuator 120 engages finger portion 104 of trigger 100, such as at a rounded end 122, thereby pivoting finger portion 104 towards handle portion 26 as trigger actuator 120 moves linearly towards handle portion 26. Trigger actuator 120 continues to engage finger portion 104 as it slides linearly towards handle portion 26 generally parallel to container well axis 44. Trigger actuator 120 is slidably received by body 12, such as in a slot, channel, rail, track, shelf, or other structure 126 along top portion 120*a* and/or bottom portion 120*b* that guides linear movement of trigger actuator 120.

Figure 7A:
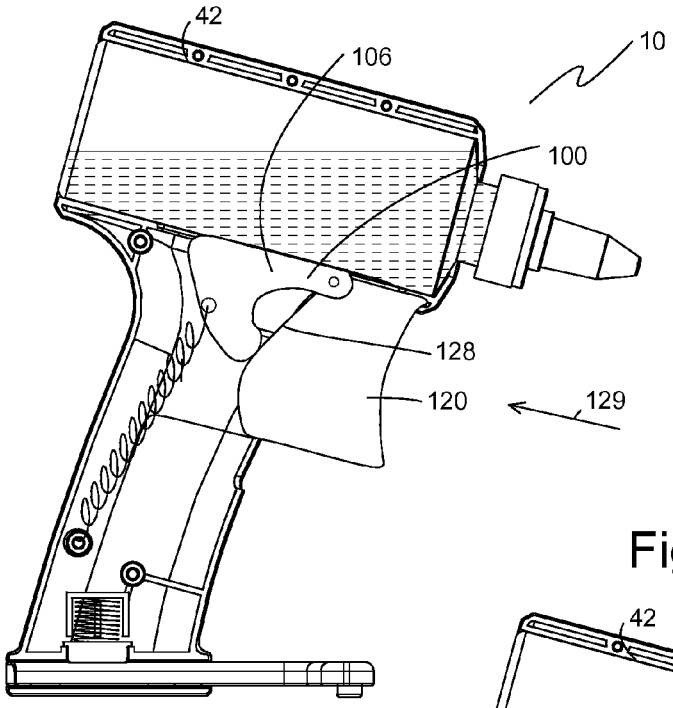
FIG. 7A is a side elevational view of a section of another embodiment of an extrusion tool showing a trigger actuator in the at-rest position.
Figure 7B:
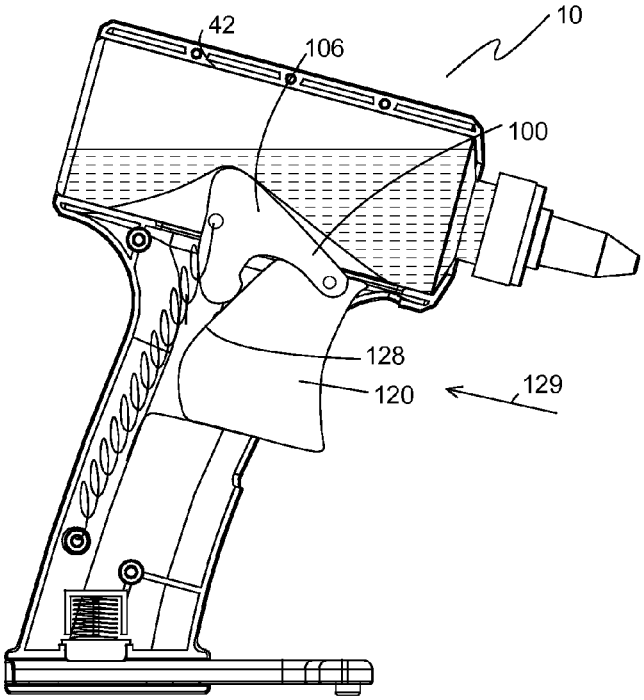
FIG. 7B is a side elevational view of the section of FIG. 7A showing the trigger actuator in an actuated position.

Referring now to FIGS. 7A and 7B, another embodiment of extrusion tool 10 has trigger actuator 120 and another embodiment of trigger 100 lacking finger portion 104. Trigger actuator 120 has a rear surface 128 that is inclined at about 45° with respect to a direction of travel 129. Rear surface 128 engages contact lever portion 106 as trigger actuator 120 moves linearly, with rear surface 128 causing contact lever portion 106 to pivot into container well 42 without the need for finger portion 104 (shown n FIGS. 6A-6B).

Figure 8:
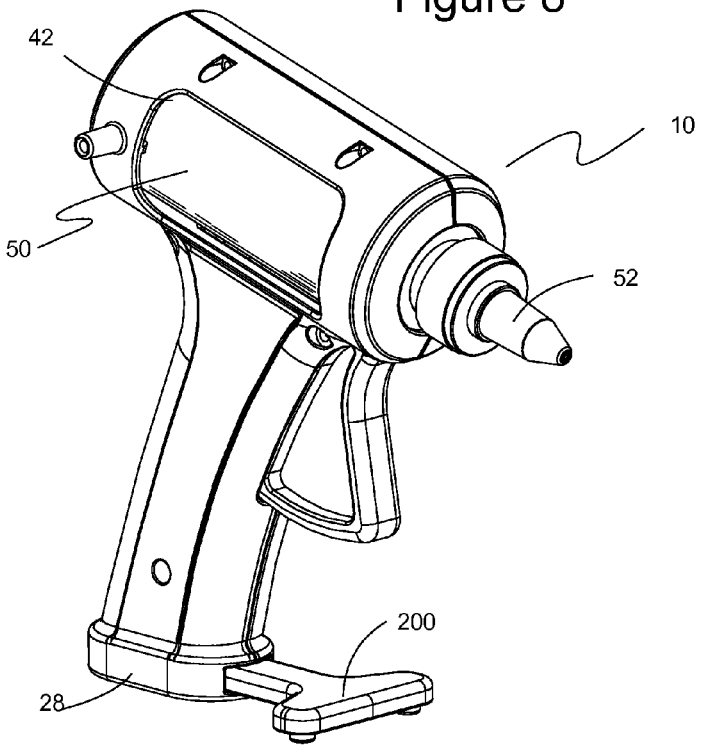
FIG. 8 is a front perspective view of the extrusion tool of FIG. 1 showing a squeeze bottle disposed in the container well of the dispenser body.

Referring now to FIG. 8, a perspective view shows one embodiment of extrusion tool 10 with squeeze container 50 disposed in container well 42 and standing in an upright position. Stand 200 is extended from base portion 28 to provide an increased base area for improved stability. Squeeze container 50 is retained in container well 42 in a declined position to enable product 54 (not visible) to flow towards nozzle 52.

Figure 9:
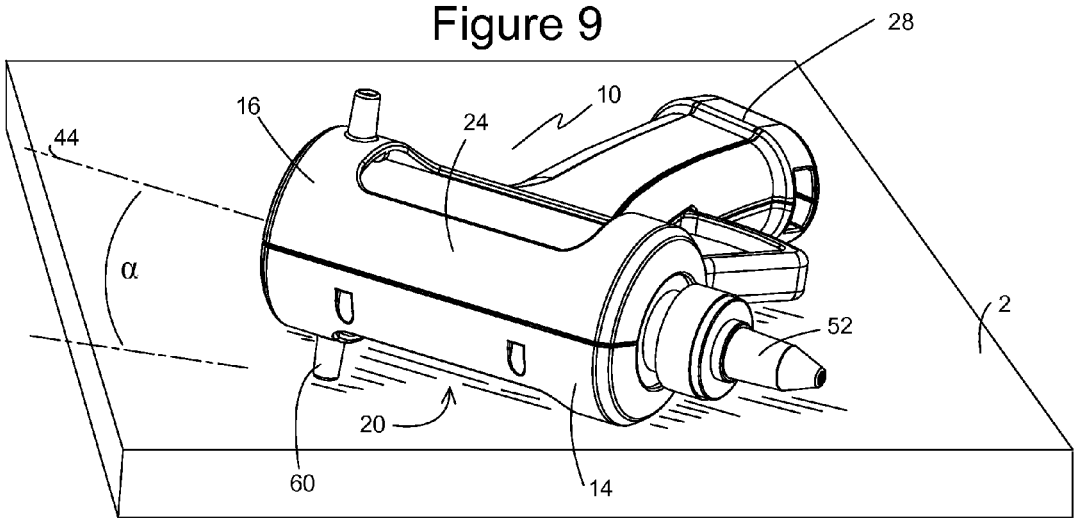
FIG. 9 is a top perspective view of the dispenser of FIG. 8 showing the extrusion tool on its side with a side support adjacent a back end of the container well.

Referring now to FIG. 9, a perspective view shows extrusion tool 10 of FIG. 8 on its side on a horizontal surface 2. As some users may prefer, stand 200 (shown in FIG. 8) has been removed from base portion 28. With stand 200 removed, extrusion tool 10 typically lies on its side contacting horizontal surface 2. To insure that product 54 within squeeze container 54 is always oriented towards nozzle 52, container well 42 has at least one of side support protrusion 60 connected to one of a rear end 42 of container-receiving portion 24 or to handle portion 26. When extrusion tool 10 is on its side, side support protrusion 60 maintains rear portion 16 of container well 42 elevated above front portion 14 of container well 42 to maintain squeeze container 50 in a declined position such that nozzle 52 is in a downward pointing orientation. The container well axis 44 and squeeze container 50 are declined at angle β to the horizontal of about 10-20°, such as 15°, towards nozzle 52. As such, product 54 (not visible) contained in squeeze container 50 flows under the force of gravity towards and into nozzle 52.

Figure 10:
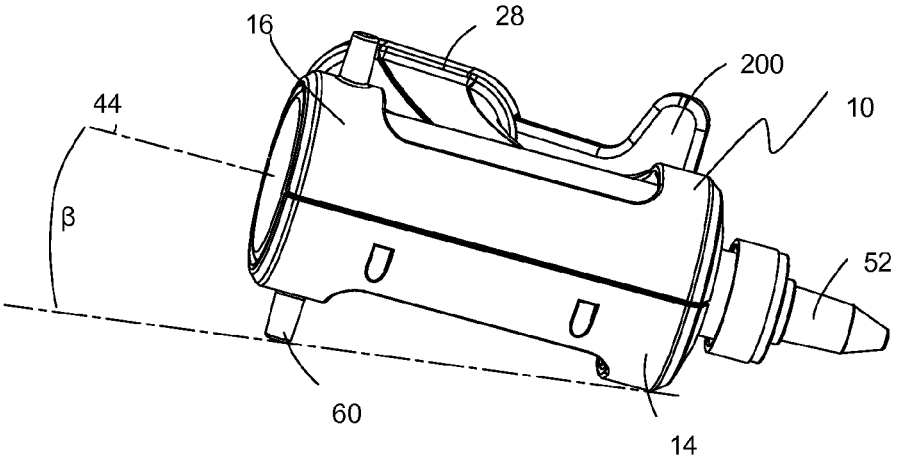
FIG. 10 is another perspective view of the dispenser of FIG. 8 showing the extrusion tool on its side.

Referring now to FIG. 10, extrusion tool 10 is shown on its side with squeeze container 50 declined at angle β to the horizontal. Here, extrusion tool 10 includes stand 200. Extrusion tool makes contact with the ground on side support protrusion, front portion 14 of container-receiving portion 24, and stand 200. Similar to as shown in FIG. 9, side support protrusion maintains rear portion 16 of container well 42 elevated above front portion 14 of container well to maintain squeeze container 50 in the declined position.

Figure 11:
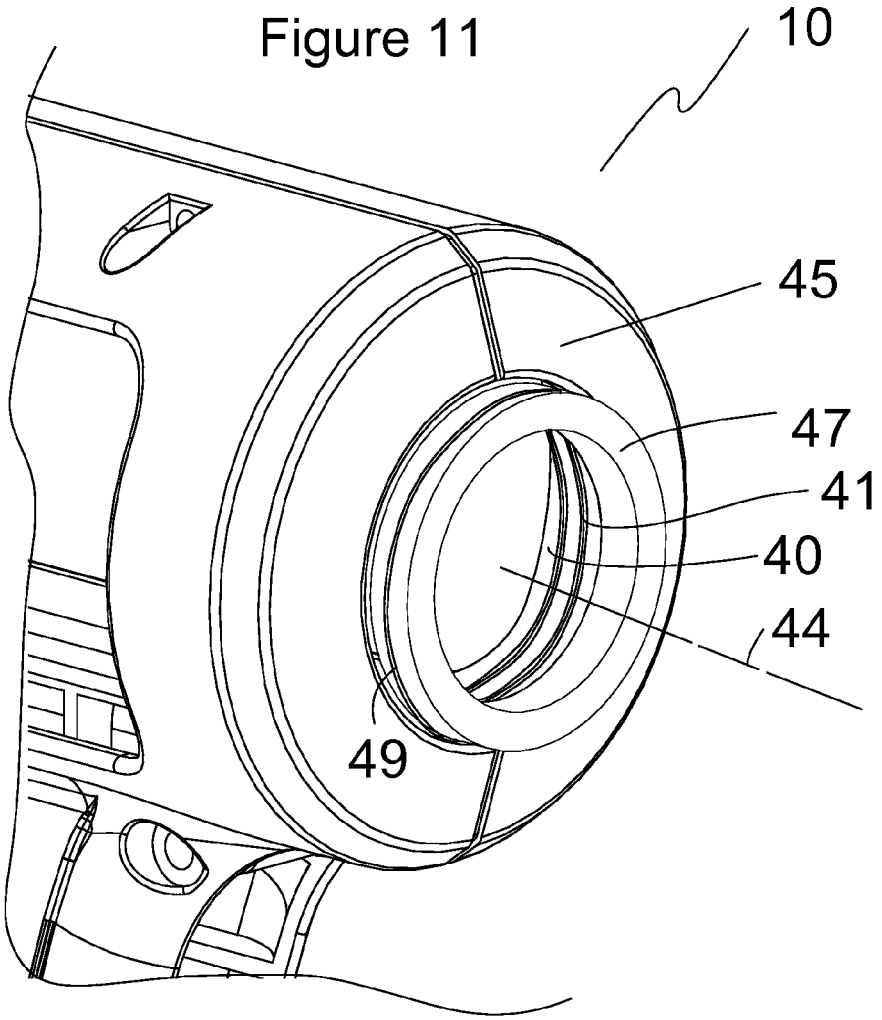
FIG. 11 is an enlarged, front perspective view of a front portion of a container-receiving portion of another embodiment of an extrusion tool of the present invention showing a rim with external threads and internal threads on an inside surface of the forward-facing aperture.

In some squeeze containers 50, nozzle 52 is designed to allow different shapes of dispensed product 54. For example, nozzle opening 52*a* may be a slit rather than a circular opening to allow for dispensed product 54 having a flat, ribbon shape, such as found on containers of some woodworking glues. Referring now to FIG. 11, a portion of another embodiment of extrusion tool 10 is shown that allows the user to attach a nozzle or nozzle cap (not shown) to forward-facing aperture 40. For squeeze containers 50 not equipped with the desired nozzle 52 or opening 52*a*, or to equip extrusion tool 10 with nozzle 52 of a desired type or quality, some embodiments of extrusion tool 10 have forward-facing aperture 40 sized and equipped with internal threads 41 to threadably engage the threaded neck 50*d* of squeeze container 50 (shown in FIG. 1), which normally attaches to a cap 56 with nozzle 52. In some embodiments, internal threads 41 form an air-tight seal between squeeze container 50 and forward-facing aperture 40. A rim 47 encircling or coaxial with forward-facing aperture 40 and extending from front end 45 along or parallel to container well axis 44 has external threads 49 constructed to threadably connect a nozzle attachment (not shown), cap 56 (shown in FIG. 1) with nozzle 52, or other dispensing attachment. In some embodiments, external threads 49 are constructed to form an air-tight seal with the nozzle attachment so that when nozzle 42 is closed, air does not enter or exit squeeze container 50. Thus, any one of a family of nozzle attachment accessories (not shown) can be attached to rim 47 for optimally dispensing product 54 as desired while also enabling the user to store extrusion tool 10 loaded with squeeze container 50 in a ready-to-use position.

In use, embodiments of extrusion tool 10 are useful for extruding liquids from a squeeze container 50. Similarly, extrusion tool 10 can be used with flowable slurries, suspensions, emulsions, gels, colloids, and other flowable substances that can be dispensed using a squeeze container. When squeeze container 50 is declined (i.e., nozzle 52 or tip is tilted downward towards the horizontal) the contents of squeeze container 50 flow under gravity to nozzle 52 and effectively flood nozzle 52 and the area around it.

Extrusion tool 10 is particularly useful for fine, precise work where accuracy is important. Due to the declined orientation of squeeze container 50 retained in container well 42, the inside of nozzle 52 is always flooded with product 54 so little or no drying or contamination of product 54 occurs. When the user is done using extrusion tool 10, he/she simply closes nozzle 52 by turning it clockwise. Extrusion tool 10 with squeeze container 50 in container well 42 can be stored indefinitely in a "ready-to-use" position.

In a method of extruding a flowable product from a squeeze container, the user provides an embodiment of extrusion tool 10 as described above and a squeeze container 50 containing a quantity of product 54 to be dispensed. The user installs squeeze container 50 into container well 42 of extrusion tool 10 with nozzle 42 extending through forward-facing aperture 40. In some embodiments, extrusion tool 10 is selected so that contact lever portion 106 purposefully interferes with squeeze container 50 to provide a snug fit that retains squeeze container 50 in container well 42.

To dispense product 54, the user opens nozzle 52, then squeezes trigger 100 towards handle portion 26 to apply pressure to squeeze container 50 and extrude product 54 through nozzle opening 52*a*. Between uses, the user may set extrusion tool 10 in an upright position or on its side while maintaining a declined position of squeeze container 50. After completing a task, the user closes nozzle 52 and can then store extrusion tool 10 with squeeze container 50 in container well 42.

Nozzle 42, typically made of a semi-flexible, non-stick material, such as LDPE or silicone rubber, is fitted with an internal thread that allows nozzle 42 to be retracted from the tip of the nozzle body to adjustably open nozzle opening 42*a*. The nozzle thread is commonly designed so that one full counterclockwise turn of nozzle 42 opens it fully and any position in between is proportionally open. In other words, one half turn counterclockwise opens nozzle 42 to about half open. This feature allows nozzle 42 to be tailored the physical properties of product 54. Also, while product 54 is ready to be extruded through nozzle opening 42*a*, product 54 does not drip or drool because the air inside squeeze container 50 and the outside air are in equilibrium so long as squeeze container 50 was allowed to equilibrate when it was sealed after its previous use.

With nozzle 52 in a closed position, extrusion tool 10 with squeeze container 50 of product 54 can remain idle indefinitely, such as for storage. In fact, an advantage exists to storing squeeze container 54 in a declined position. So long as the inside parts of nozzle 52 are continuously flooded with product 54, no localized "crusting" from dried product 54 occurs. In most squeeze containers 50 stored with nozzle 52 in an upright position, a thin skin of dried product 54, that was left in or around nozzle 52 from the previous use, remains in place and sometimes interferes with the perfect function of nozzle 52 when subsequently attempting to dispense product 54. Typically, the user has to pick away the encrusted material before product 54 can be dispensed. It can be understood that if nozzle 52 is always "wet" inside, then this crusting is greatly reduced or eliminated because the seal and the interface with air is right at nozzle opening 52.

To extrude the liquid, the user simply squeezes trigger 100 (or trigger actuator 120) to cause contact lever portion 106 to pivot about trigger pin 102 into squeeze container 50. This action simulates and takes the place of the user's hand squeezing squeeze container 50 to dispense product 54 from squeeze container 50. The action of trigger 100 mimics the finger squeeze to deform squeeze container 50, causes a volume reduction in squeeze container 50, and therefore increases pressure within squeeze container 50. With squeeze container 50 declined, product 54 has flowed to nozzle 52 and the now-pressurized air inside squeeze container 50 is behind product 50. As a result, the pressurized air applies a force on product 54 sufficient for product 54 to flow through open nozzle 52.

While some envisioned uses of extrusion tool have been discussed, extrusion tool 10 could be employed to dispense many liquid materials used by crafters, handymen, do-it-yourselfers, cake decorators, mechanics, and industrial workers. As noted above, container well 42 can be shaped to accept and snugly retain squeeze containers 50 having an ovoid or other cross-sectional shape, squeeze containers 50 smaller or larger than the common 4 oz. container, longer squeeze containers 50 and other variations of squeeze container 50 as illustrated. While the elastomeric nature of squeeze container 50 enables an applied force to extrude the product contained within, the physics of handling liquids is a function of the liquid properties and nozzle 52.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. An extrusion tool for use with a squeeze container with a conical dispensing nozzle, the extrusion tool comprising:

a dispenser body having a handle portion, a container-receiving portion, and a base portion, wherein the handle portion is connected to and extends between the container-receiving portion and the base portion, wherein the container-receiving portion defines a container well extending along a container well axis from an open rear end to a front end defining a central aperture, the container well being constructed and arranged to removably receive a squeeze container through the open rear end and retain the squeeze container in the container well with a conical dispensing nozzle of the squeeze container extending through the central aperture; and a trigger operatively connected to the dispenser body and pivotable between a non-dispensing position and a dispensing position, wherein the trigger has a contact lever portion oriented to move into the container well in a direction transverse to the container well axis when the trigger is moved to the dispensing position and thereby deform a sidewall of the squeeze container retained in the container well.

2. The extrusion tool of claim 1, wherein when the extrusion tool is in the upright position, the container well is inclined to the horizontal surface, thereby positioning the conical dispensing nozzle of the squeeze container in a downward direction.

3. The extrusion tool of claim 2, wherein the container well is inclined from about 10 to 20 degrees with respect to the horizontal.

4. An extrusion tool comprising:

a dispenser body having a handle portion, a container-receiving portion, and a base portion, the handle portion connected to and extending between the container-receiving portion and the base portion, wherein the container-receiving portion defines a forward-facing aperture and a container well extending along a container well axis, the container well being constructed and arranged to receive and retain a squeeze container therein with a nozzle of the squeeze container extending through the forward-facing aperture; and a trigger operatively connected to the dispenser body and movable between a non-dispensing position and a dispensing position wherein the trigger has a finger portion and a contact lever portion oriented to move into and out of the container well when the finger portion is moved between the non-dispensing position and the dispensing position; and an adjustable stand connected to the base portion.

5. The extrusion tool of claim 4, wherein the adjustable stand is slidably received by the base portion and adjustable between a first stand position and a second stand position.

6. The extrusion tool of claim 4, wherein the adjustable stand is removable from the base portion.

7. The extrusion tool of claim 4, wherein the adjustable stand is hingedly connected to the base portion and foldable between a first stand position and a second stand position.

8. The extrusion tool of claim 1 further comprising at least one side support protrusion extending transversely from the container-receiving portion, the at least one side support protrusion being one of a plurality of contact points when the extrusion tool is at rest on a horizontal surface with the handle portion extending substantially horizontally.

9. The extrusion tool of claim 1, further comprising a trigger actuator that moves linearly with respect to the handle portion, wherein moving the trigger actuator towards the handle portion engages the finger portion to pivot the contact lever portion into the container well.

10. The extrusion tool of claim 1, further comprising a spring connected between the trigger and the dispenser body, wherein the spring biases the contact lever portion to return to an at-rest position with the contact lever portion substantially retracted from the trigger well.

11. The extrusion tool of claim 1, wherein the contact lever portion extends up to 0.03 inch into the container well to interfere with and maintain the squeeze container in the container well when the trigger is in the non-dispensing position.

12. The extrusion tool of claim 1, further comprising the squeeze container sized and shaped to be installed through the open rear end and retained in the container well, the squeeze container comprising:

an elastomeric body made of a pliable material and extending between a first end portion and a second end portion; and a conical dispensing nozzle on the first end portion of the elastomeric body, wherein the conical dispensing nozzle is selectively openable by a user to dispense a liquid through the nozzle when the elastomeric body is squeezed.

13. The extrusion tool of claim 12, wherein the contact lever portion contacts the squeeze container to interfere with and maintain the squeeze container in the container well when the trigger is in the non-dispensing position.

14. A method of dispensing a liquid from a squeeze container comprising:

providing an extrusion tool comprising:

a dispenser body having a handle portion connected to and extending between a container-receiving portion and a base portion, wherein the container-receiving portion defines a container well with an open rear end and a forward aperture, the container well being constructed and arranged to receive and retain a squeeze container therein with a nozzle of the squeeze container extending through the forward aperture; and a trigger operatively connected to the dispenser body and having a finger portion and a contact lever portion, wherein moving the finger portion towards the handle portion moves the contact lever portion into the container well;

providing a squeeze container having a sidewall extending from a first end to a second end and a conical dispensing nozzle connected to the first end of the squeeze container, wherein the squeeze container contains a quantity of liquid to be dispensed;

placing the squeeze container in the container well via the open rear end with the conical dispensing nozzle extending through the forward aperture and with the sidewall of the squeeze container adjacent the contact lever portion of the trigger; and squeezing the trigger and causing the contact lever portion to apply pressure to the side wall of the squeeze container, thereby deforming the sidewall of the squeeze container and dispensing the quantity of liquid through the conical dispensing nozzle.

15. The method of claim 14, further comprising:

selecting the extrusion tool to include a stand adjustably connected to the base portion and operable between a first stand position and a second stand position.

16. The method of claim 14, further comprising:

selecting the extrusion tool having a side support protrusion positioned on the dispenser body wherein the container well is in an inclined position with the rear portion above the front portion when the extrusion tool is oriented on an extrusion tool side on a horizontal surface.

17. The method of claim 14 further comprising selecting the trigger with the finger portion being about 1.6× longer than the contact lever portion, thereby providing a mechanical advantage to the user when dispensing the quantity of liquid.

* * * * *